US008292412B2

(12) United States Patent
Tamaki

(10) Patent No.: US 8,292,412 B2
(45) Date of Patent: Oct. 23, 2012

(54) INK-JET RECORDING APPARATUS

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 529 days.

(21) Appl. No.: 12/509,273

(22) Filed: Jul. 24, 2009

(65) Prior Publication Data

US 2010/0053279 A1 Mar. 4, 2010

(30) Foreign Application Priority Data

Aug. 28, 2008 (JP) ..... 2008-219074

(51) Int. Cl.
*B41J 2/175* (2006.01)
*B41J 2/18* (2006.01)

(52) U.S. Cl. ..... 347/85; 347/89

(58) Field of Classification Search ..... None
See application file for complete search history.

(56) References Cited

U.S. PATENT DOCUMENTS

| | | | | |
|---|---|---|---|---|
| 7,399,075 | B2 | 7/2008 | Nomura et al. | |
| 7,690,777 | B2 * | 4/2010 | Wada | 347/93 |
| 2006/0164478 | A1 | 7/2006 | Fukazawa | |

FOREIGN PATENT DOCUMENTS

| | | | |
|---|---|---|---|
| JP | S57-149149 | U | 9/1982 |
| JP | 2002-200771 | A | 7/2002 |
| JP | 2002-326371 | A | 11/2002 |
| JP | 2003-063023 | A | 3/2003 |
| JP | 2003063023 | A * | 3/2003 |
| JP | 2003-266745 | A | 9/2003 |
| JP | 2004-098475 | A | 4/2004 |
| JP | 2005-103964 | A | 4/2005 |
| JP | 2005-306005 | A | 11/2005 |
| JP | 2006-205528 | A | 8/2006 |
| JP | 2006-247901 | A | 9/2006 |
| JP | 2006-263996 | A | 10/2006 |
| JP | 2008-188963 | A | 8/2008 |

OTHER PUBLICATIONS

Japan Patent Office; Notification of Reason for Refusal in Japanese Patent Application No. 2008-219074 (counterpart to the above-captioned US Patent Application) mailed on Jul. 6, 2010.

The State Intellectual Property Office of the People's Republic of China, Notification of First Office Action for Chinese Patent Application No. 200910164901.3 (counterpart to above-captioned patent application), issued Sep. 8, 2010.

* cited by examiner

*Primary Examiner* — Matthew Luu
*Assistant Examiner* — Erica Lin
(74) *Attorney, Agent, or Firm* — Baker Botts L.L.P.

(57) ABSTRACT

An ink-jet recording apparatus including a recording head for ejecting an ink, an auxiliary reservoir having an upstream chamber and a downstream chamber both open to the atmosphere and configured to store the ink, a first supply passage for supplying the ink from the downstream chamber of the auxiliary reservoir to the recording head, a return passage for returning the ink from the recording head to the upstream chamber of the auxiliary reservoir, and a partition portion which divides an internal space of the auxiliary reservoir into the upstream and downstream chambers and which has a filter section at least partially contacting the ink in the upstream and downstream chambers.

17 Claims, 6 Drawing Sheets

INK-JET RECORDING APPARATUS

CROSS REFERENCE TO RELATED APPLICATION

The present application claims the priority from Japanese Patent Application No. 2008-219074 filed Aug. 28, 2008, the disclosure of which is herein incorporated by reference in its entirety.

BACKGROUND OF THE INVENTION

1. Field of the Invention

The present invention relates to an ink-jet recording apparatus configured to print images.

2. Description of Related Art

U.S. Pat. No. 7,399,075 B2 discloses an ink-jet printer having two ink passages consisting of a supply passage for supplying an ink from an auxiliary reservoir to a printing head, and a return passage for returning the ink from the printing head to the auxiliary reservoir when the printing head is subjected to a purging operation wherein the ink supplied from the auxiliary reservoir to the printing head is returned to the auxiliary reservoir.

In the ink jet printer disclosed in the above-identified publication, however, the auxiliary reservoir is not divided into two ink chambers by a filter, giving rise to a risk of plugging of nozzles of the printing head with foreign matters contained in the supply and return passages through which the ink is circulated. In view of this drawback, it is considered possible to provide the ink-jet printer of the publication with a filter that divides the auxiliary reservoir into the two ink chambers, as disclosed in JP-2003-266745 A. In the ink-jet printer disclosed in this publication, however, only the second ink chamber of the auxiliary reservoir is open to the atmosphere, but the first ink chamber is not open to the atmosphere, so that the filter is likely to be clogged with air bubbles contained in the first ink chamber. Accordingly, the pressure within the return passage for returning the ink from the printing head to the auxiliary reservoir tends to be raised during the purging operation of the printing head, causing destruction of the meniscus of the ink at the nozzles of the printing head, with a result of unintended ejection of the ink droplets from the printing head during the purging operation.

SUMMARY OF THE INVENTION

The present invention was made in view of the background art described above. It is therefore an object of the present invention to provide an ink-jet recording apparatus arranged to reduce a risk of closing of the filter of the auxiliary reservoir with the air bubbles, for thereby reducing a risk of ejection of the ink from the printing head during the purging operation.

The object indicated above can be achieved according to the principle of the present invention, which provides an ink-jet recording apparatus comprising: a recording head configured to eject an ink; an auxiliary reservoir having an upstream chamber and a downstream chamber that are both open to an atmosphere, and configured to store the ink; a first supply passage for supplying the ink from the downstream chamber of the auxiliary reservoir to the recording head; a return passage for returning the ink from the recording head to the upstream chamber of the auxiliary reservoir; and a partition portion dividing an internal space of the auxiliary reservoir into the upstream and downstream chambers, and having a filter section at least partially contacting the ink in the upstream and downstream chambers.

In the ink-jet recording apparatus constructed according to the present invention, the upstream chamber and the downstream chamber of the auxiliary reservoir are both held open to the atmosphere, so that air bubbles are allowed to flow from the ink in the two chambers of the auxiliary reservoir into the atmosphere, and are less likely to adhere to the filter section. Accordingly, the filter section is less likely to be clogged with the air bubbles, during a purging operation wherein the ink supplied from the downstream chamber of the auxiliary reservoir to the recording head is returned to the upstream chamber of the auxiliary reservoir. Therefore, it is possible to reduce a risk of unintended ejection of the ink droplets from the recording head due to a pressure rise in the upstream chamber and in the return passage, which would take place due to impermeability of the filter section caused by the clogging of the filter section.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which.

DETAILED DESCRIPTION OF THE PREFERRED EMBODIMENTS

First Embodiment

A first preferred embodiment of an ink-jet recording apparatus of the present invention in the form of an ink-jet printer will be described by reference to FIGS. 1-3. The ink-jet printer is arranged to print images such as characters with an ink ejected onto a recording medium such as sheets of paper. The ink-jet printer of the first embodiment, which is shown in the schematic view of FIG. 1, includes an auxiliary reservoir 3 shown in enlarged view of FIG. 2.

Figure 1:
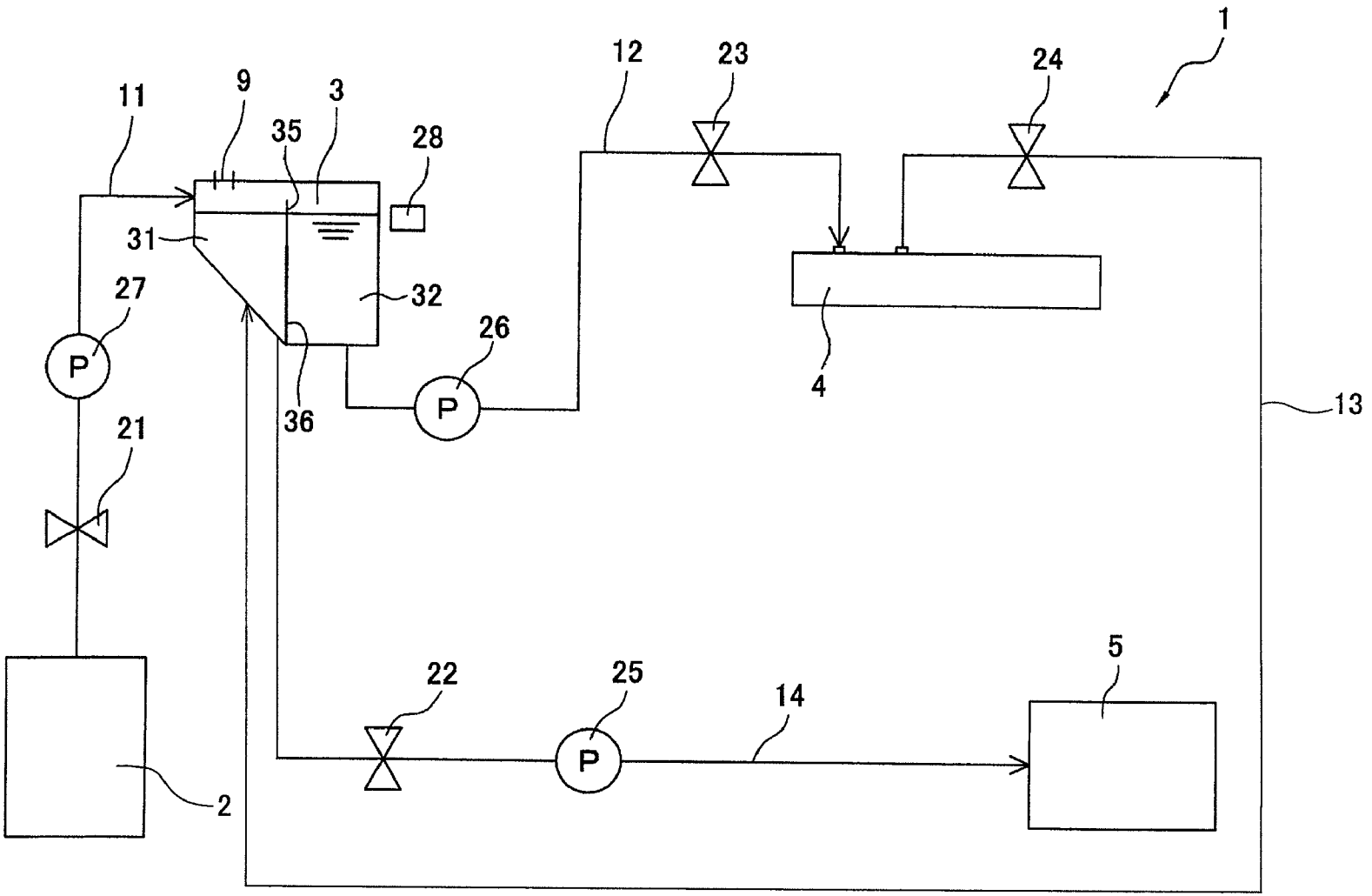
FIG. 1 is a schematic view of an ink-jet printer constructed according to a first embodiment of the present invention.

As shown I FIG. 1, the ink-jet printer 1 includes a main reservoir in the form of an ink cartridge 2, the above-indicated auxiliary reservoir 3, a recording head in the form of an ink-jet head 4, and a waste reservoir 5.

The ink cartridge 2 is connected to an upstream chamber 31 (described below) of the auxiliary reservoir 3 through a second supply passage in the form of a second supply tube 11 that is provided with a shut-off valve 21 and a second supply tube pump 27. An ink is supplied from the auxiliary reservoir 3 through the second supply tube 11 to the upstream chamber 31. As shown in FIG. 2, the second supply tube 11 is connected to a part of a side wall 31*a* of the upstream chamber 31, which part is higher than an upper limit position A described below, so that the ink is prevented from flowing from the auxiliary reservoir 3 when there arises a leakage of the ink from a joint between the ink cartridge 2 and the second supply tube 11 or from the second supply tube 11, whereby the amount of leakage of the ink from the auxiliary reservoir 3 is reduced.

The auxiliary reservoir 3 has an opening 9 formed in a top wall, for communication of an internal space of the auxiliary reservoir 3 with the atmosphere, so that the ink supplied from the ink cartridge 2 through the second supply tube 11 can be temporarily stored or accommodated in the internal space of the auxiliary reservoir 3. A level of the ink within the auxiliary reservoir 3 is detected by an ink level sensor 28, which may be an optical sensor, for instance. An amount of supply of the ink from the ink cartridge 2 into the auxiliary reservoir 3 is controlled by a second supply-tube-pump control portion 65 described below, on the basis of an output signal of the ink level sensor 28, such that the level of the ink within the auxiliary reservoir 3 is kept at a position between the above-indicated upper limit position A and a lower limit position B. The ink stored in the auxiliary reservoir 3 has the largest volume when the level of the ink is at the upper limit position A, and the smallest volume when the level of the ink is at the lower limit position B.

The auxiliary reservoir 3 is provided with a partition portion 34 consisting of an upper plate section 35 and a lower filter section 36. The partition portion 34 extends vertically upwards from a bottom wall 32*a* of the auxiliary reservoir 3 to a position below the top wall of the auxiliary reservoir 3 and above the above-indicated upper limit position A. That is, the upper plate section 35 has an upper end which is higher than the upper limit position A at which the ink stored in the auxiliary reservoir 3 has the largest volume. The partition portion 34 divides an internal space of the auxiliary reservoir 3 into an upstream chamber 31 and a downstream chamber 32. However, the upstream and downstream chambers 31, 32 are not completely separated from each other by the partition portion 34, but air spaces in the two chambers 31, 32 are held in communication with each other. Namely, the upper end of the plate section 35 of the partition portion 34 is spaced downwards from the top wall of the auxiliary reservoir 3, so as to form a suitable air communication gap between upper spaces of the upstream and downstream chambers 31, 32. In the presence of the opening 9 for communication of the upstream chamber 31 with the atmosphere, the downstream chamber 32 is also held in communication with the atmosphere through the above-indicated gap. Accordingly, it is not necessary to provide both of the upstream and downstream chambers 31, 32 with respective two openings. The provision of the single opening 9 makes it possible to keep the ink pressures in both of the upstream and downstream chambers 31, 32 at a constant value.

Figure 2:
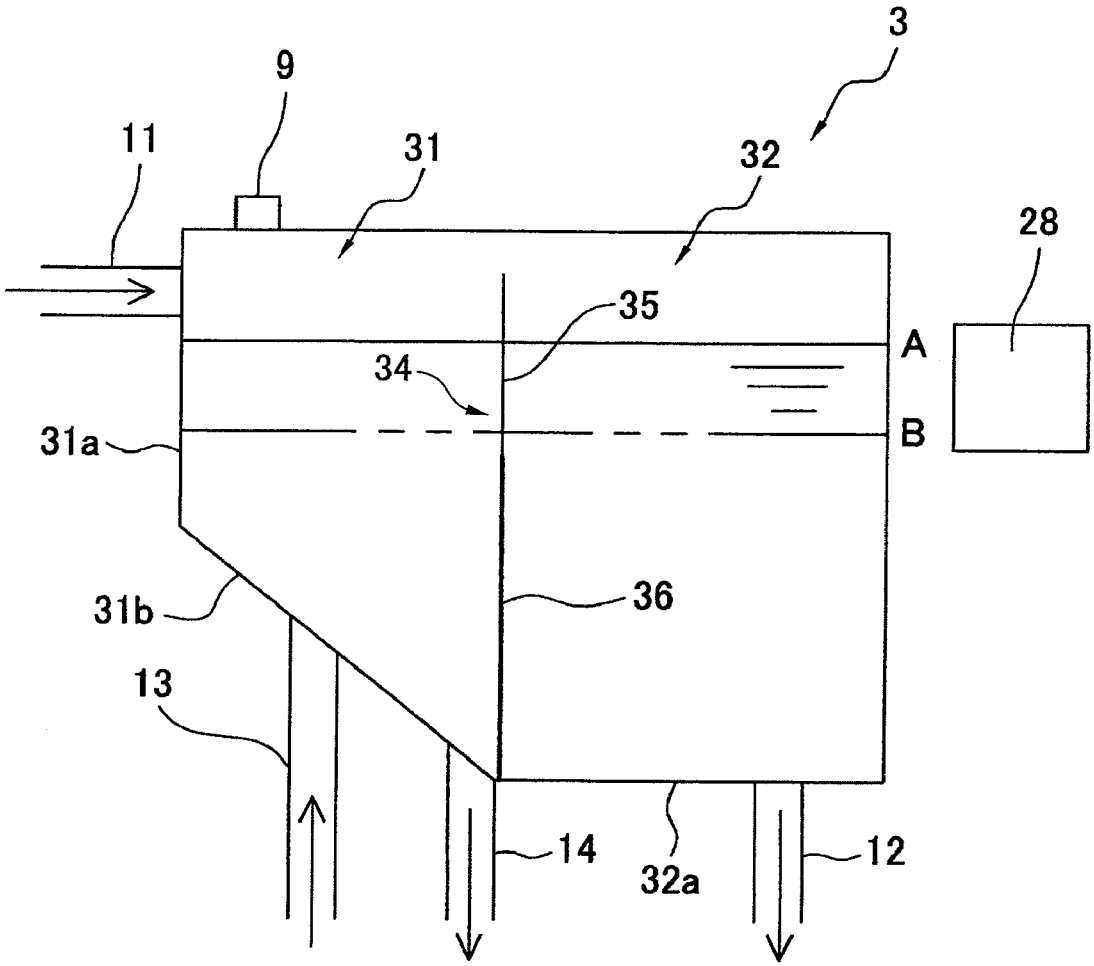
FIG. 2 is an enlarged view of an auxiliary reservoir of the ink-jet printer of FIG. 1.

The upstream chamber 31 of the auxiliary reservoir 3 is partially defined by a bottom wall 31*b*, which is inclined such that the bottom wall 31*b* descends as the bottom wall 31*b* extends towards the downstream chamber 32, that is, such that the depth of the upstream chamber 31 defined by the bottom wall 31*b* increases as the bottom wall extends in the right direction as seen in FIG. 2. The upstream chamber 31 of the auxiliary reservoir 3 accommodates the ink supplied from the ink cartridge 2 through the second supply tube 11. The lower filter section 36 of the partition portion 34, which permits the ink to permeate therethrough, is located below the lower limit position B, and extends vertically upwards from a joint between the inclined wall 31*b* and the bottom wall 32*a*, up to a position located below the lower limit position B. The ink supplied from the ink cartridge 2 through the second supply tube 11 into the upstream chamber 31 is supplied through the filter section 36 into the downstream chamber 32. Namely, the ink can flow between the upstream and downstream chambers 31, 32, through only the filter section 36, so that the filter section 36 prevents flows of foreign matters between the upstream and downstream chambers 31, 32. In other words, the filter section 36 of the partition portion 34 permits the flows of the ink between the upstream and downstream chambers 31, 32, while the plate section 35 inhibits the flows of the ink between the upstream and downstream chambers 31, 32.

If the filter section 36 was exposed to the atmosphere, the foreign matters would tend to be deposited on a mesh structure of the filter 36 exposed to the atmosphere. If the filter section 36 was kept exposed to the atmosphere for some length of time, the viscosity of the ink adhering to the mesh structure of the filter section 36 would undesirably increase. To prevent this drawback, the filter section 36 is located below the lower limit position B, to prevent exposure of the filter section 36 to the atmosphere, for thereby avoiding clogging of the filter with the foreign matters.

The auxiliary reservoir 3 is also connected to a waste reservoir 5 through a discharge passage in the form of a discharge tube 14, which is provided with a shut-off valve 22 and a waste tube pump 25. The discharge tube 14 is connected to a lowest end part of the inclined bottom wall 31*b* of the upstream chamber 31, which lowest end part is close to the lower end of the filter section 36 (partition portion 34). Since the internal space of the auxiliary reservoir 3 is open to the atmosphere, the ink accommodated in the auxiliary reservoir 3 is easily dried, and the viscosity of the ink tends to increase as the ink is aged. The relatively aged ink within the auxiliary reservoir 3 is discharged from the upstream chamber 31 into the waste reservoir 5 through the discharge tube 14, and from the downstream chamber 31 through the filter section 36, upstream chamber 31 and discharge tube 14, and a fresh mass of the ink is supplied from the ink cartridge 2 into the auxiliary reservoir 3.

Since the discharge tube 14 is connected to the lowest part of the inclined bottom wall 31*b* of the upstream chamber 31, the foreign matters contained in the upstream chamber 31 can be efficiently discharged into the waste reservoir 5. Further, the inclination of the bottom wall 31*b* such that the bottom wall 31*b* descends as the bottom wall 31*b* extends towards the downstream chamber 32 facilitates downward movements of the foreign matters into the discharge tube 14. In addition, the filter section 36 extending vertically upwards from the bottom wall 32*a* of the downstream chamber 32 permits a large amount of the ink within the downstream chamber 32 to be discharged into the waste reservoir 5.

The auxiliary reservoir 3 is further connected to the ink-jet head 4 through a first supply passage in the form of a first supply tube 12 that is provided with a first supply tube pump 26 and a shut-off valve 23, which are arranged such that the first supply tube pump 26 is located between the auxiliary reservoir 3 and the shut-off valve 23. The first supply tube 12 is connected a lowest part of the downstream chamber 32, that is, connected to the bottom wall 32*a* of the downstream chamber 32 of the auxiliary reservoir 3, so that air bubbles contained in the downstream chamber 32 are less likely to be moved into the ink-jet head 4 through the first supply tube 12.

The ink-jet head 4 has a multiplicity of nozzles (not shown), and an ink passage system (not shown) formed therein for delivering the ink received from the downstream chamber 32 of the auxiliary reservoir 3 through the first supply tube 12, into the nozzles. The ink is ejected from the selected ones of the nozzles when the ink-jet head 4 is opposed to a recording medium (sheet of paper) P which is fed by a feeding mechanism (not shown).

The ink passage system formed within the ink-jet head 4 for delivering the ink received through the first supply tube 12 to the nozzles is branched to the upstream chamber 31 of the auxiliary reservoir 3 through a return passage in the form of a return tube 13 that is provided with a shut-off valve 24. As shown in FIG. 2, the return tube 13 is connected to a part of the bottom wall 31*b* of the upstream chamber 31, which is lower than the lower limit position B and which is more distant from the filter section 36 of the partition portion 34, than the discharge tube 14. The return tube 13 may be connected to any other portion of the walls 31*a*, 31*b* of the upstream chamber 31, which is lower than the lower limit position B, for example, to a portion of the side wall 31*a* that is lower than the lower limit position B.

The ink-jet printer 1 is configured to implement a purging operation of the ink-jet head 4 when a relatively large volume of air bubbles is contained in the ink supplied to the ink jet head 4 from the downstream chamber 32 through the first supply tube 12. In the purging operation, the ink containing the air bubbles is returned to the upstream chamber 31 through the return tube 13. In the presence of the opening 9 for communication of the internal space of the auxiliary reservoir 3 with the atmosphere, the air bubbles contained in the ink returned from the ink-jet head 4 to the upstream chamber 31 of the auxiliary reservoir 3 are allowed to flow into the atmosphere. This purging operation prevents the air bubbles from reaching the nozzles of the ink-jet head 4, together with the ink.

As indicated above, the position at which the return tube 13 is connected to the bottom wall 31*b* of the upstream chamber 31 is lower than the lower limit position B, so that the ink returned through the return tube 13 flows into the mass of the ink accommodated in the upstream chamber 31, with a result of preventing bubbling of the ink. On the other hand, the position at which the discharge tube 14 is connected to the upstream chamber 31 is closer to the filter section 36 than the position at which the return tube 13 is connected to the upstream chamber 31. Namely, a part of the bottom wall 31*b* to which the discharge tube 14 is connected is closer to the filter section 36 than a part of the bottom wall 31*b* to which the return tube 13 is connected. Accordingly, the foreign matters adhering to the surface of the filter section 36 on the side of the upstream chamber 32 are easily discharged into the waste reservoir 5, with a result of maintaining the permeability of the filter section 36. In other words, the return tube 13 is connected to the part of the bottom wall 31*b* which is relatively distant from the filter section 36, so that the air bubbles contained in the ink returned through the return tube 13 into the upstream chamber 31 are less likely to adhere to the filter section 36. Since the discharge tube 14 as well as the return tube 13 is connected to the upstream chamber 31, the foreign matters returned with the ink through the return tube 13 are prevented by the filter section 36 from flowing into the downstream chamber 32, but are permitted to be discharged into the waste reservoir 5 through the discharge tube 14.

Referring next to the schematic block diagram of FIG. 3, there will next be described a control system of the ink-jet printer 1 according to the first embodiment of this invention. The ink-jet printer 1 is provided with a controller 60 incorporating a CPU (central processing unit) operable to perform arithmetic operations, a ROM (read-only memory) storing control programs executed by the CPU and data used for the control program, and a RAM (random-access memory) temporarily storing data during execution of the control programs.

Figure 3:
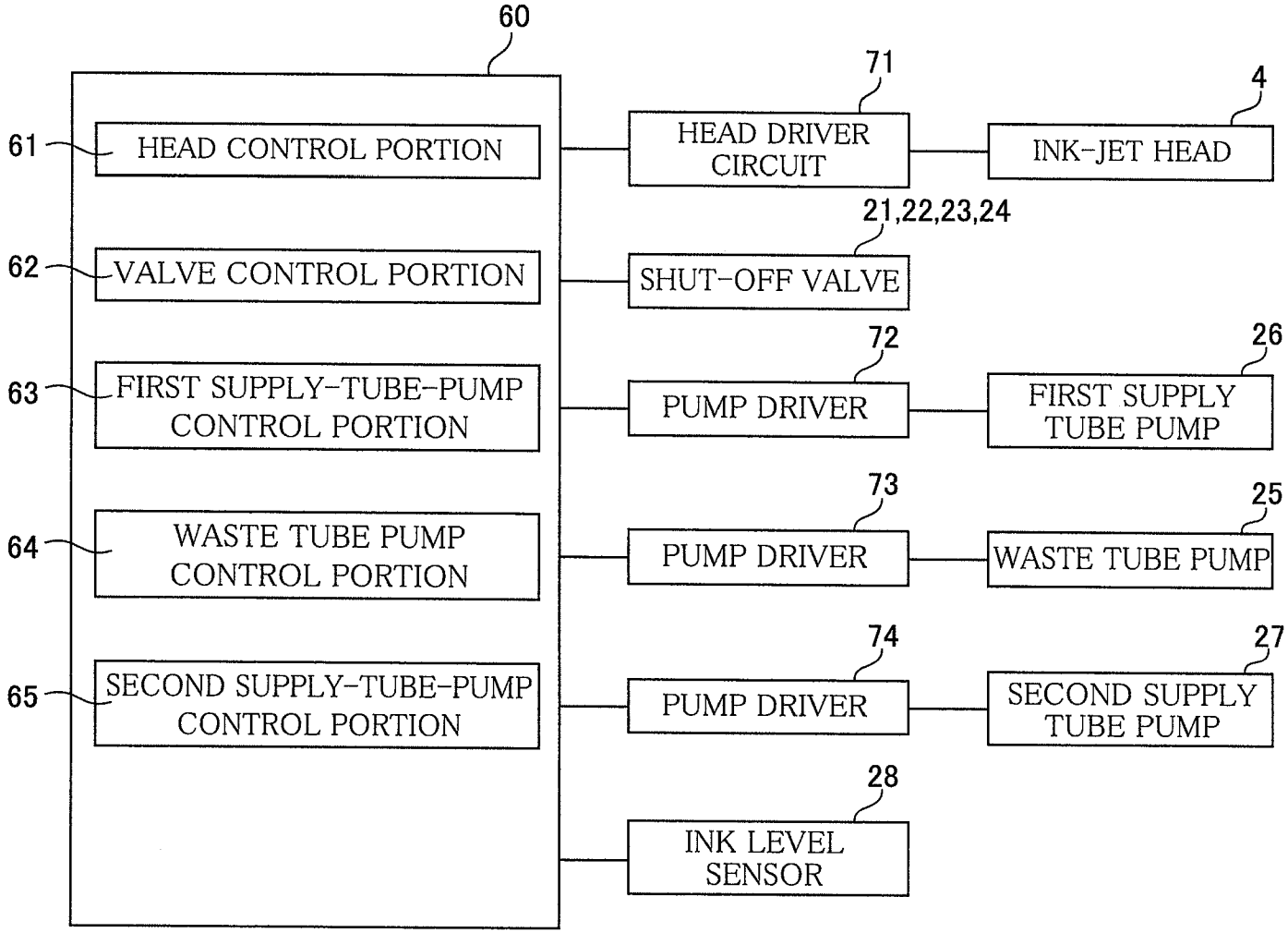
FIG. 3 is a schematic block diagram showing a control system of the ink-jet printer according to the first embodiment.

As shown in FIG. 3, the controller 60 includes a head control portion 61, a valve control portion 62, a first supply-tube-pump control portion 63, a waste tube pump control portion 64, and the second supply-tube-pump control portion 65 described above with respect to the level of the ink within the auxiliary reservoir 3.

The head control portion 61 is configured to control a head driver circuit 71 according to a printing signal received by the controller 60 from an external PC (personal computer) not shown, for operating the ink-jet head 4 to eject droplets of the ink, for performing a printing operation to print images on the sheet of paper P. The operation of the shut-off valves 21, 22, 23, 24 and the operations of the waste tube pump 25, first supply tube pump 26 and second supply tube pump 27 during the printing operation will be described.

The valve control portion 62 is configured to open and close the shut-off valves 21, 22, 23, 24, and the first supply-tube-pump control portion 63 is configured to control a pump driver 72 for operating the first supply tube pump 26. The waste tube pump control portion 64 is configured to control a pump driver 73 for operating the waste tube pump 25, while the second supply-tube-pump control portion 65 is configured to control a pump driver 74 for operating the second supply tube pump 27.

Then, an operation to supply the ink from the ink cartridge 2 to the upstream chamber 31 of the auxiliary reservoir 3 will be described. When a drop of the level of the ink within the auxiliary reservoir 3 below the lower limit position B is detected by the ink level sensor 28 as a result of a supply of the ink from the auxiliary reservoir 3 to the ink-jet head 4, the valve control portion 62 opens the shut-off valve 21, and the second supply-tube-pump control portion 65 operates the second supply tube pump 27 to supply the ink from the ink cartridge 2 to the upstream chamber 31 of the auxiliary reservoir 3.

When a rise of the level of the ink within the auxiliary reservoir 3 to the upper limit position A is detected by the ink level sensor 28 as a result of a supply of the ink from the ink cartridge 2 into the upstream chamber 31, the valve control portion 62 closes the shut-off valve 21, and the second supply-tube-pump control portion 65 turns off the second supply tube pump 27, for stopping the supply of the ink from the ink cartridge 2 to the upstream chamber 31 of the auxiliary reservoir 3. In the manner described above, the level of the ink within the auxiliary reservoir 3 is kept within a predetermined range between the upper limit position A and the lower limit position B. It will be understood that the ink level sensor 28, valve control portion 62 and second supply-tube-pump control portion 65 cooperate with each other to function as an ink level control portion configured to control the level of the ink within the auxiliary reservoir 3, such that the level of the ink is kept between the upper and lower limit positions A and B.

An operation to discharge the ink from the auxiliary reservoir 3 will be described next. In this operation, the shut-off valve 22 is opened by the valve control portion 62 while the waste tube pump 25 is operated by the waste tube pump control portion 64, so that the ink 9 is sucked out from the upstream chamber 31 of the auxiliary reservoir 3 into the waste reservoir 5 through the discharge tube 14. With the ink being sucked out from the upstream chamber 31 into the waste reservoir 5, the ink in the downstream chamber 32 is discharged into the waste reservoir 5 through the filter section 36, upstream chamber 31 and discharge tube 14. After a predetermined volume of the ink has been discharged from the auxiliary reservoir 3 into the waste reservoir 5, the shut-off valve 22 is closed by the valve control portion 62, and the waste tube pump 25 is turned off by the waste tube pump control portion 64. Thereafter, a fresh volume of the ink is supplied from the ink cartridge 2 into the auxiliary reservoir 3 through the second supply tube 11, as described above.

Then, a printing operation of the ink-jet printer 1 will be described. In the printing operation, the shut-off valves 21, 22 and 24 (shown in FIG. 1) are held in the closed state, while the shut-off valve 23 (also shown in FIG. 1) is placed in the open state, under the control of the valve control portion 62. The waste tube pump 25 and the second supply tube pump 27 are held at rest under the control of the waste tube pump control portion 64 and second supply-tube-pump control portion 65, while the first supply tube pump 26 is at rest under the control of the first supply-tube-pump control portion 63. In this condition, the head driver circuit 71 of the ink-jet printer 1 is controlled by the head control portion 61, to perform the printing operation wherein droplets of the ink supplied from the auxiliary reservoir 3 to the ink-jet head 4 through the first supply tube 12 are ejected from the selected nozzles corresponding to selected ones of actuators built in the ink-jet head 4.

The purging operation of the ink-jet head 4 will then be described. In the purging operation, the ink containing air bubbles is returned from the ink-jet head 4 into the upstream chamber 31 of the auxiliary reservoir 3 through the return tube 13, in order to prevent clogging of the nozzles of the ink-jet head 4 with the air bubbles contained in the ink supplied to the ink-jet head 4 through the first supply tube 12. The air bubbles contained in the ink returned to the upstream chamber 31 flow from the auxiliary reservoir 3 through the opening 9. In the purging operation, the foreign matters contained in the downstream chamber 32 and the first supply tube 12 and moved into the ink-jet head 4 are also returned to the upstream chamber 31, so that the foreign matters thus accommodated in the upstream chamber 31 in the purging operation are discharged into the waste reservoir 5 when the aged ink in the auxiliary reservoir 3 is discharged into the waste reservoir 5. In the purging operation, the shut-off valves 21 and 22 are held in the closed, while the shut-off valves 23 and 24 are held in the open state, under the control of the valve control portion 62.

In the purging operation, the first supply tube pump 26 is operated by the first supply-tube-pump control portion 63, to feed the ink from the downstream chamber 32 of the auxiliary reservoir 3 into the ink-jet head 4. The ink fed into the ink-jet head 4 is then fed into the return tube 13 through the shut-off valve 24 placed in the open state, since the return tube 13 has a lower flow resistance than the passages leading to the nozzles. Thus, the ink is returned from the downstream chamber 32 of the auxiliary reservoir 3 through the return tube 13. The purging operation is performed as long as the shut-off valves 23 and 24 are held open while the first supply tube pump 26 is operated.

In the ink-jet printer 1 constructed according to the present first embodiment of this invention which has been described, the upstream chamber 31 and the downstream chamber 32 of the auxiliary reservoir 3 are both open to the atmosphere, for permitting air bubbles to escape from the auxiliary reservoir 3 into the atmosphere, making it possible to reduce a risk of continuing adhesion of the air bubbles to the filter section 36 of the partition portion 34, and consequent clogging of the filter section 36 with the air bubbles, during the purging operation in which the ink supplied from the downstream chamber 32 of the auxiliary reservoir 3 into the ink-jet head 4 is returned into the upstream chamber 31. If the filter section 36 was clogged with the air bubbles, the pressure of the ink in the ink-jet head 4 would be undesirably raised, leading to destruction of the meniscus of the ink at the nozzles of the ink-jet head 4, with a result of unintended ejection of the ink droplets from the ink-jet head 4 during the purging operation. In the present ink-jet printer 1, however, the filter section 36 is not likely to be clogged with the air bubbles as described above, and the ink pressure in the upstream chamber 31 and return tube 13 will not rise due to the clogging of the filter section 36, making it possible to reduce the risk of the unintended ejection of the ink droplets from the ink-jet head 4.

Second Embodiment

A second embodiment of this invention will be described by reference to the enlarged view of FIG. 4. The ink-jet printer according to the second embodiment is identical in construction with the ink-jet printer 1 of the first embodiment, except for an arrangement of a partition portion 134 which is different from the partition portion 34 in the first embodiment shown in FIG. 2. The same reference signs as used in the first embodiment will be used in the second embodiment to identify the corresponding elements.

Figure 4:
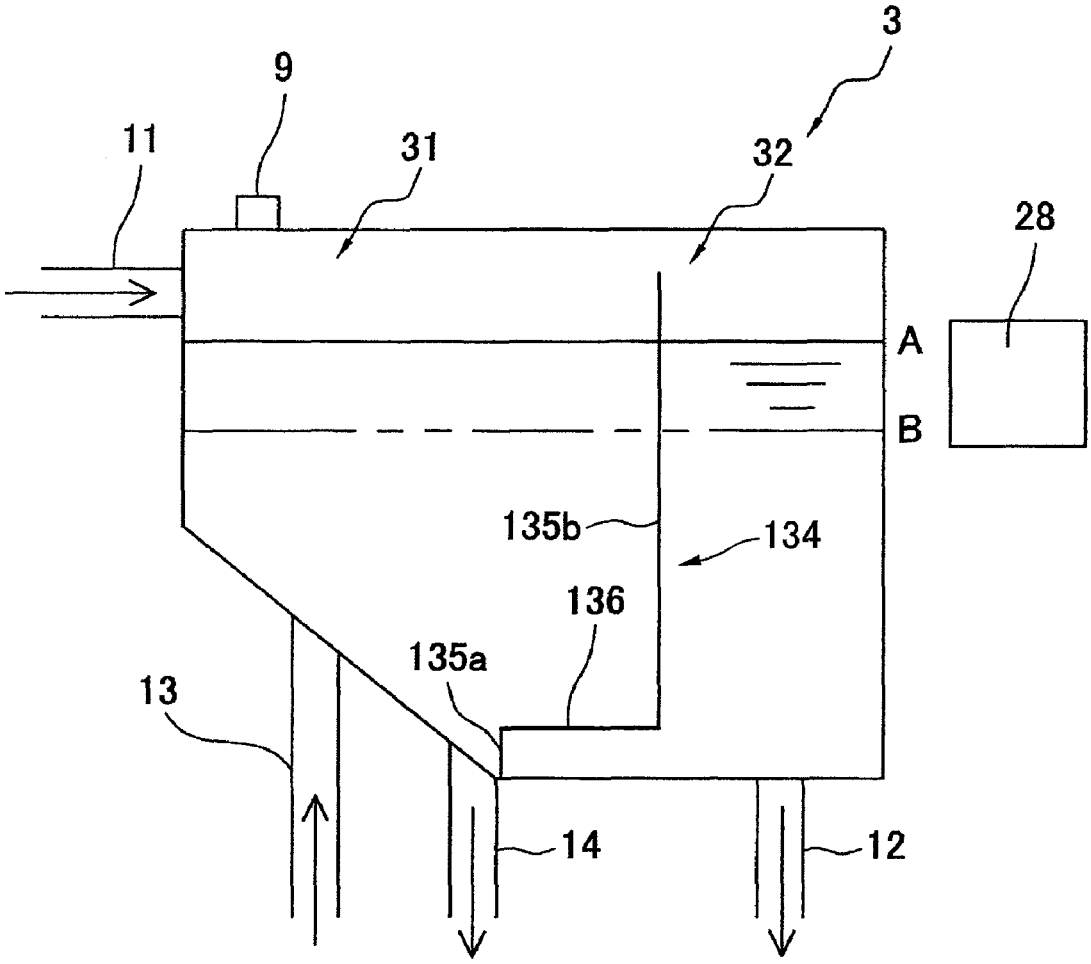
FIG. 4 is an enlarged view of an auxiliary reservoir of an ink-jet printer constructed according to a second embodiment of this invention.

As shown in FIG. 4, the partition portion 134 consists of a first plate section 135*a* extending vertically upwards from the bottom wall of the auxiliary reservoir 3, up to a position below the lower limit position B, a filter portion 136 extending horizontally from the upper end of the first plate portion 135*a* in the direction from the upstream chamber 31 toward the downstream chamber 32, and a second plate portion 135*b* extending vertically upwards from one of the opposite ends of the filter section 136 remote from the first plate section 135*a*, up to a position above the upper limit position A. In the partition portion 134, the filter section 136 extends horizontally in the direction from the upstream chamber 31 toward the downstream chamber 32, so that the air bubbles returned into the upstream chamber 31 through the return tube 13 are unlikely to adhere to the filter section 136.

In the second embodiment, the partition portion 134 has the first plate section 135*a* extending vertically upwards from the bottom wall of the auxiliary reservoir 3 up to the position below the lower limit position B, and the filter section 136 extending from the upper end of the first plate section 135*a* in the horizontal direction from the upstream chamber 31 toward the downstream chamber 32. However, this arrangement of the partition portion 134 is not essential. For example, the first plate portion 135*a* may be inclined with respect to the vertical direction, provided the upper end of the first plate portion 135*a* is located at a position below the lower limit position B. Similarly, the filter section 136 may be inclined with respect to the horizontal direction, provided the filter section 136 is entirely located below the lower limit position B.

Third Embodiment

A third embodiment of this invention will be described by reference to the enlarged view of FIG. 5. The ink-jet printer according to the third embodiment is identical in construction with the ink-jet printer 1 of the first embodiment, except for an arrangement of a partition portion 234 which is different from the partition portion 34 in the first embodiment. The same reference signs as used in the first embodiment will be used in the third embodiment to identify the corresponding elements.

Figure 5:
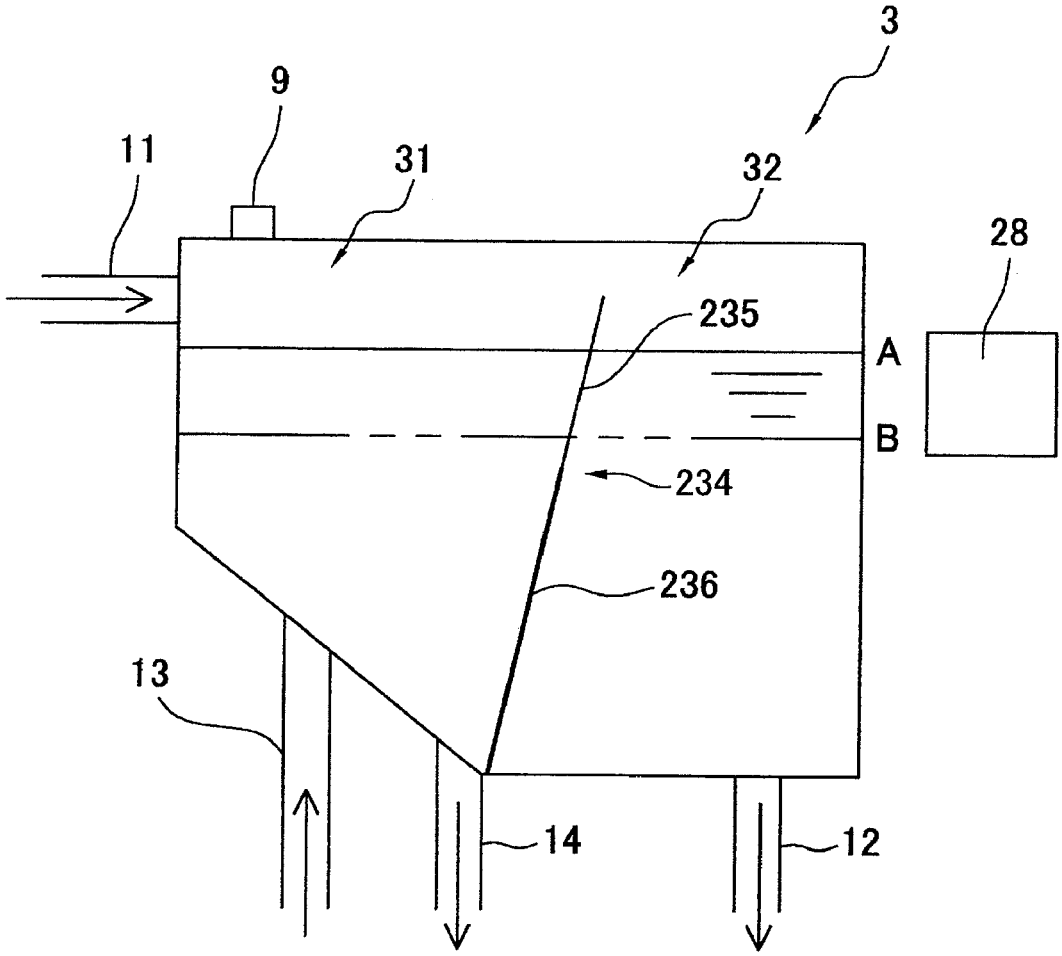
FIG. 5 is an enlarged view of an auxiliary reservoir of an ink-jet printer constructed according to a third embodiment of this invention.

As shown in FIG. 5, the partition portion 234 is inclined with respect to the vertical, in a direction from the upstream chamber 31 toward the downstream chamber 32, such that the partition portion 234 ascends from the bottom wall of the auxiliary reservoir 3 as the partition portion 234 extends in the right direction as seen in FIG. 5 toward the downstream chamber 32. The partition portion 234 consists of a plate section 235 and a filter section 236. The filter section 236, which permits permeation of the ink therethrough, extends from the bottom wall of the auxiliary reservoir 3, more precisely, from a joint between the bottom walls of the upstream and downstream chambers 31, 32, up to a position below the lower limit position B, while the plate section 235 extends from the upper end of the filter section 136 up to a position above the upper limit position A and below the top wall of the auxiliary reservoir 3. In the present partition portion 234, the air bubbles returned into the upstream chamber 31 through the return tube 13 are unlikely to adhere to the inclined filter section 236. Further, the foreign matters adhering to the surface of the partition portion 234 on the side of the upstream chamber 31 easily drop downwards.

Fourth Embodiment

A fourth embodiment of this invention will be described by reference to the enlarged view of FIG. 6. The ink-jet printer according to the second embodiment is identical in construction with the ink-jet printer 1 of the first embodiment, except for an arrangement of a partition portion 334 which is different from the partition portion 34 in the first embodiment. The same reference signs as used in the first embodiment will be used in the fourth embodiment to identify the corresponding elements.

Figure 6:
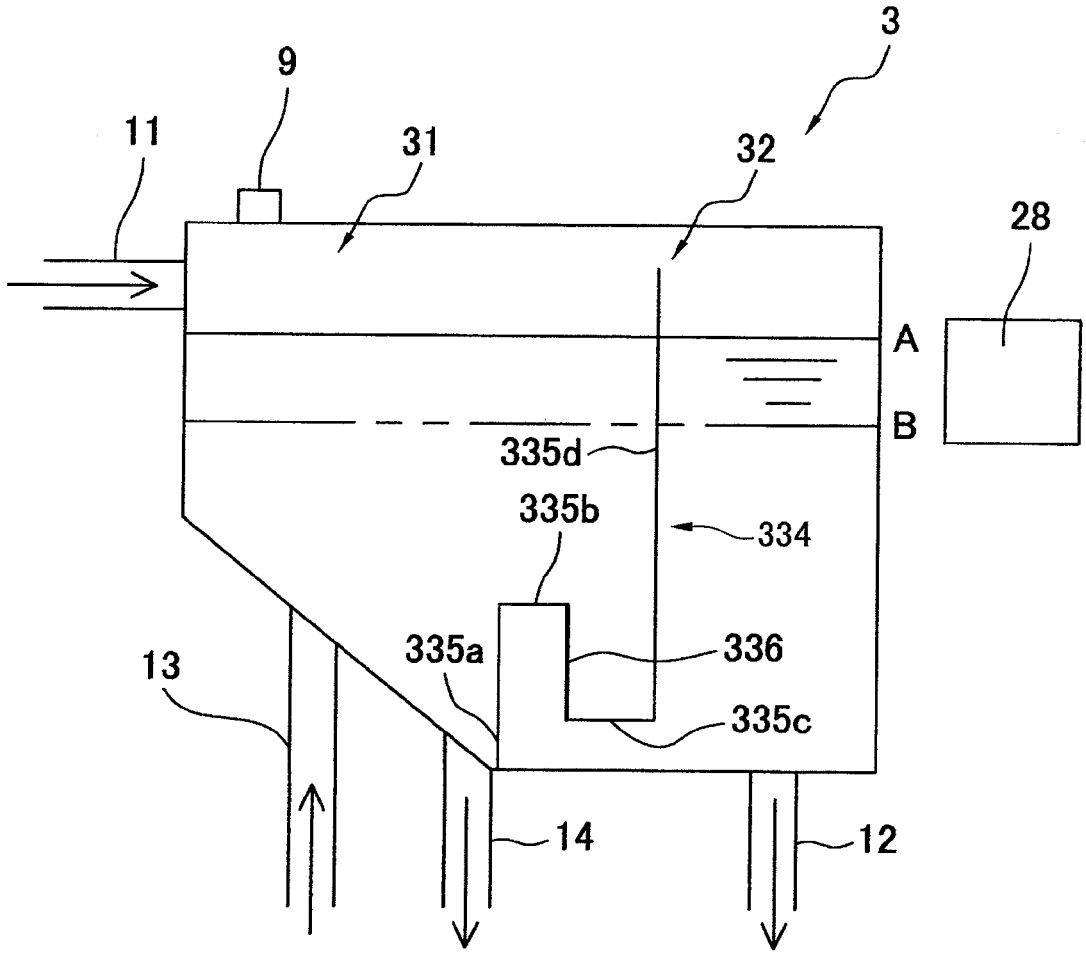
FIG. 6 is an enlarged view of an auxiliary reservoir of an ink-jet printer constructed according to a fourth embodiment of this invention.

As shown in FIG. 6, the partition portion 334 consists of a first plate section 335*a* extending vertically upwards from the bottom wall of the auxiliary reservoir 3, up to a position below the lower limit position B, a second plate section 335*b* extending horizontally from the upper end of the first plate section 335*a* in the direction from the upstream chamber 31 toward the downstream chamber 32, a filter section 336 extending vertically downwards from one of the opposite ends of the second plate section 335*b* remote from the first plate section 335*a*, a third plate section 335*c* extending horizontally from the lower end of the filter section 336 in the direction from the upstream chamber 31 toward the downstream chamber 32, and a fourth plate section 335*d* extending vertically upwards from one of the opposite ends of the third plate section 335*c* remote from the filter section 336, up to a position above the upper limit position A. In the present partition portion 334, the air bubbles returned into the upstream chamber 31 through the return tube 13 are unlikely to arrive at and adhere to the filter section 336. For the air bubbles to arrive at the filter section 336, the air bubbles must flow over the second plate section 335*b* into a space between the filter section 336 and the fourth plate section 335*d*.

The partition portion 334 according to the fourth embodiment may be modified as needed. For example, the first plate section 335*a* may be inclined with respect to the vertical direction, provided the upper end of the first plate section 335*a* is located below the lower limit position B, and the second plate section 335*b* may be inclined with respect to the horizontal direction, provided the filter section 336 is entirely located below the lower limit position B. Further, the third plate section 335*c* may be inclined with respect to the horizontal direction.

Other modifications of the partition portions 34, 134, 234, 334 in the illustrated embodiment are possible. For instance, the auxiliary reservoir 3 may be provided with a partition portion which entirely consists of a filter, without the provision of any plate section.

The auxiliary reservoir 3 may be provided with a partition portion extending from the bottom wall to the top wall of the auxiliary reservoir 3. In this case, the top walls of the upstream and downstream chambers 31, 32 are formed with respect openings for communication of the respective two chambers 31, 32 with the atmosphere.

The partition portion 34 according to the illustrated first embodiment may be replaced by a partition portion in the form of a film which divides the internal space of the auxiliary reservoir 3 into the upstream and downstream chambers 31, 32 and which is provided with a filter section. In the illustrated embodiments, the auxiliary reservoir 3 consists of a single housing structure. However, the auxiliary reservoir may consist of two housing structures each having an upstream chamber and a downstream chamber. In this case, the two housing structures are butted together such that butted walls of the two housing structures constitute a partition portion that is provided with a filter which permits flows of the ink between the upstream and downstream chambers. The upstream and downstream chambers may be held in communication with each other through an opening formed through the button walls. While the bottom wall 31*b* of the upstream chamber 31 of the auxiliary reservoir 3 in the first embodiment is entirely inclined such that the depth of the upstream chamber 31 increases as the bottom wall 31*b* extends towards the downstream chamber 32, only a selected section of the bottom wall of the upstream chamber 31 may be inclined. In other words, the bottom wall may consist of an inclined section and a horizontally extending section.

While the ink-jet printers according to the present invention have been described, the principle of the present invention is applicable to any other ink-jet recording apparatus such as a facsimile or telecopier apparatus, and a copying apparatus.

What is claimed is:

1. An ink-jet recording apparatus comprising:

a recording head configured to eject an ink;

an auxiliary reservoir having an upstream chamber and a downstream chamber that are both open to an atmosphere, and configured to store the ink;

a first supply passage for supplying the ink from the downstream chamber of the auxiliary reservoir to the recording head;

a return passage for returning the ink from the recording head to the upstream chamber of the auxiliary reservoir;

a partition portion dividing an internal space of the auxiliary reservoir into the upstream and downstream chambers, and having a plate section inhibiting flows of the ink between the upstream and downstream chambers and having an upper end which is higher than a first level of the ink when the auxiliary reservoir stores therein a largest volume of the ink, the partition portion further having a filter section contacting the ink in the upstream and downstream chambers; and an ink level control portion configured to control a level of the ink within the auxiliary reservoir, such that the level of ink within the auxiliary reservoir is kept between said first level, and a second level which is higher than a bottom wall of the auxiliary reservoir when the auxiliary reservoir stores therein a smallest volume of the ink, and wherein the plate section has a first plate extending upwards from the bottom wall to a position lower than the second level of the ink, said filter section extending from an upper end of the first plate in a horizontal direction, the plate section further having a second plate extending upwards from one of the opposite ends of the filter section remote from the first plate section to a position higher than said first level of the ink.

2. The ink jet recording apparatus according to claim 1, wherein the partition portion extends from a bottom wall of the auxiliary reservoir into the internal space of the auxiliary reservoir.

3. The ink jet recording apparatus according to claim 1, wherein the upstream and downstream chambers of the auxiliary reservoir have respective upper air spaces communicating with each other within the auxiliary reservoir.

4. The ink jet recording apparatus according to claim 3, wherein the partition portion extends from a bottom wall of the auxiliary reservoir to a position below a top wall of the auxiliary reservoir.

5. The ink jet recording apparatus according to claim 3, wherein the partition portion has an upper end spaced downwards from a top wall of the auxiliary reservoir.

6. The ink jet recording apparatus according to claim 1, wherein the first supply passage is connected to a lowest part of the downstream chamber of the auxiliary reservoir.

7. The ink jet recording apparatus according to claim 1, wherein the return passage is connected to a part of the upstream chamber of the auxiliary reservoir, which part is lower than the second level of the ink.

8. The ink-jet recording apparatus according to claim 1, further comprising:

a main reservoir from which the ink is supplied to the auxiliary reservoir; and a second supply passage through which the ink is supplied from the main reservoir to the upstream chamber of the auxiliary reservoir, and wherein the second supply passage is connected to a part of the upstream chamber, which part is higher than a level of the ink when the auxiliary reservoir stores therein a largest volume of the ink.

9. The ink-jet recording apparatus according to claim 1, wherein the filter section is disposed such that an upper end of the filter section is lower than a level of the ink when the auxiliary reservoir stores therein a smallest volume of the ink.

10. The ink-jet recording apparatus according to claim 1, further comprising:

a waste reservoir for storing the ink discharged from the auxiliary reservoir; and a discharge passage through which the ink is discharged from the upstream chamber of the auxiliary reservoir to the waste reservoir, and wherein a position at which the discharge passage is connected to the upstream chamber is closer to the filter section than a position at which the return passage is connected to the upstream chamber.

11. The ink jet recording apparatus according to claim 10, wherein the return passage and the discharge passage are connected to a bottom wall of the upstream chamber, such that a part of the bottom wall to which the discharge passage is connected is closer to the filter section than a part of the bottom wall to which the return passage is connected.

12. The ink jet recording apparatus according to claim 10, wherein the discharge passage is connected to a lowest part of the upstream chamber.

13. The ink jet recording apparatus according to claim 12, wherein the upstream chamber has a bottom wall at least a portion of which is inclined such that said portion descends as the portion extends toward the downstream chamber.

14. The ink jet recording apparatus according to claim 12, wherein the filter section extends upwards from a bottom wall of the auxiliary reservoir.

15. The ink jet recording apparatus according to claim 1, wherein the partition portion extends vertically upwards from the bottom wall.

16. The ink jet recording apparatus according to claim 1, wherein the partition portion extends from the bottom wall and is inclined such that the partition portion ascends from the bottom wall as the partition portion extends toward the downstream chamber.

17. An ink-jet recording apparatus comprising:

a recording head configured to eject an ink;

an auxiliary reservoir having an upstream chamber and a downstream chamber that are both open to an atmosphere, and configured to store the ink;

a first supply passage for supplying the ink from the downstream chamber of the auxiliary reservoir to the recording head;

a return passage for returning the ink from the recording head to the upstream chamber of the auxiliary reservoir;

a partition portion dividing an internal space of the auxiliary reservoir into the upstream and downstream chambers, and having a plate section inhibiting flows of the ink between the upstream and downstream chambers and having an upper end which is higher than a first level of the ink when the auxiliary reservoir stores therein a largest volume of the ink, the partition portion further having a filter section contacting the ink in the upstream and downstream chambers; and an ink level control portion configured to control a level of the ink within the auxiliary reservoir, such that the level of the ink within the auxiliary reservoir is kept between said first level, and a second level which is higher than the bottom wall of the auxiliary reservoir when the auxiliary reservoir stores therein a smallest volume of the ink, and wherein the plate comprising a first plate extending upwards from the bottom wall to a position lower than the second level of the ink and a second plate extending from an upper end of the first plate in a horizontal direction, said filter section extending downwards from one of opposite ends of the second plate remote from the first plate, the plate section further comprising a third plate extending from a lower end of the filter section in the horizontal direction, and a fourth plate extending upwards from one of opposite ends of the third plate remote from the filter section to a position higher than said first level of the ink.

* * * * *